US005729919A

United States Patent [19]

DeBoer

[11] Patent Number: 5,729,919

[45] Date of Patent: Mar. 24, 1998

[54] PLOW BLADE

[76] Inventor: Gerald Pearl DeBoer, Rte. 2, Box 267, Crookston, Minn. 56716

[21] Appl. No.: 869,660

[22] Filed: Jun. 5, 1997

Related U.S. Application Data

[63] Continuation-in-part of Ser. No. 740,748, Nov. 1, 1996, abandoned.

[51] Int. Cl.[6] ..... E01H 5/00

[52] U.S. Cl. ..... 37/270; 37/266; 37/234

[58] Field of Search ..... 37/232, 233, 234, 37/231, 266, 267, 268, 269, 270, 416; 172/821, 826, 827, 372

[56] References Cited

U.S. PATENT DOCUMENTS

| | | | |
|---|---|---|---|
| 1,707,979 | 11/1929 | Linn | 37/232 |
| 2,228,450 | 1/1941 | Gaddis | 37/279 |
| 2,486,372 | 10/1949 | Rockwell | 37/231 X |
| 2,884,720 | 5/1959 | Meyer et al. | 37/270 X |
| 3,391,478 | 7/1968 | Astill | 37/270 X |
| 3,465,456 | 9/1969 | Meyer | 37/233 |
| 4,208,812 | 6/1980 | Brownly | 37/41 |
| 4,962,600 | 10/1990 | Zellaha et al. | 37/216 X |
| 5,020,603 | 6/1991 | Harrell | 172/219 X |
| 5,435,082 | 7/1995 | Frenette et al. | 37/235 |

*Primary Examiner*—Terry Lee Melius
*Assistant Examiner*—Robert Pezzuto
*Attorney, Agent, or Firm*—Curtis V. Harr

[57] ABSTRACT

The present invention comprises one or more anti-drift stabilizers mounted on the leading edge of a snow plow's blade. These stabilizers are mounted at an angle that is in the same direction as the angle of the snowplow in relation to the plow truck. As snow or other media is channeled to one side of a plow blade it exerts a force in the opposite direction thus tending to cause a plow to want to knife or drift in a direction opposite where the snow or other media is being deposited by the blade. As snow or other media passes over the surfaces of the stabilizers it exerts pressure that is opposite to, and counteracts the knifing action created at the emptying end of the plow by the accumulation of snow. The result of this is that the plow can be operated safely without the need to make constant corrections for the knifing and without the added danger of the inattentive operator being pulled from the roadway or into oncoming traffic and causing property damage or personal injury.

14 Claims, 14 Drawing Sheets

PLOW BLADE

This application is a continuation-in-part of application Ser. No. 08/740,748, filed Nov. 1, 1996, now abandoned.

BACKGROUND OF THE INVENTION

The present invention relates to an improvement in the design of the blade of a snowplow. More specifically, a design method which keeps the snowplow and the vehicle to which it is attached traveling in a straight direction. This invention helps to prevent the vehicle from being pulled to one side due to the knifing action of the blade as it displaces snow which accumulates against the snowplow blade.

Generally, snowplows are used by state highway departments, municipalities, private companies and individuals for the purpose of clearing roadways, parking lots, driveways or other areas after a heavy snowfall. Typically, snowplows consist of a snowplow blade which is attached to the front portion of a truck or similar large vehicle. The blade is attached to a vehicle at an angle, such that one end of the snowplow blade travels a significant distance in front of the vehicle and the other end is situated near or behind the forward most edge of the vehicle on the side to which the driver wants to deposit the excess snow, often the passenger side of said vehicle. As the vehicle moves forward, snow is accumulated on the front most surface of the snowplow and is then funneled off to one side of the plow vehicle. As the snow is funneled to one direction, it exerts a force on the plow vehicle in an equal and opposite direction thus, tending to cause a plow to knife towards the opposite direction.

This knifing and pushing motion, along with slippery and icy roads, commonly accompanying heavy snowfalls, often results in the necessity of the operator making constant corrections to keep the vehicle on its intended path. The end result of this situation is that plow vehicles may be pushed off the roadway or towards the center into oncoming traffic. While this problem occurs most frequently when the plow vehicle is moving at a high speed, it also may occur when the snow accumulated on the plow blade is excessive. The greatest danger from this tendency may also come from the fact that on two lane roads it tends to move the snowplow directly into oncoming traffic.

This problem can impact the ability of state or local agencies as well as private companies and individuals to cost-effectively and efficiently remove snow from roadways after significant snow accumulation. Vehicles that are pulled off the road and become stuck in a ditch not only cannot perform their plowing duties, but may cause property damage, require costly towing services, or pose a danger to passing motorists or pedestrians by partially or completely blocking roadways and sidewalks.

From the foregoing discussion, it can clearly be seen that it would be desirable to provide a method of preventing the forward surface of a snowplow blade from knifing and thus biasing the plow vehicle to one side, in turn, keeping the vehicle from being pulled off the road.

SUMMARY OF THE INVENTION

It is the primary objective of the present invention to provide a means of allowing a conventional snow plow or other plow to be used without the need to make constant corrections to counteract the knifing action created on the outside edge of the plow when pushing snow or other media.

It is a further object of the present invention to provide a means of limiting the accident potential created by the drag on the snowplow.

These objectives are accomplished by the use of one or more anti-drift stabilizers mounted on the leading edge of the plow's blade. These stabilizers are mounted at an angle from the front of the plow blade that is in the same direction as the angle of the snowplow in relation to the plow truck. As snow passes over the surfaces of the stabilizers it exerts pressure that is opposite to and counteracts the knifing created by the angled blade as it is pushed forward and channels snow to one side. The result of this is that the snowplow can be operated safely without the need to make constant corrections for the knifing and without the added danger of the inattentive operator being pulled from the roadway or into oncoming traffic, thus, causing property damage, serious injury or death.

A second type of plow that is often used is a bi-directional plow. This type of plow is attached to a vehicle through an adjustable frame work which allows the plow blade to be adjustably biased towards either side of the vehicle. Thus, moving snow or impediments, either to the left or to the right, as may be required by a given circumstance.

A second embodiment of the anti-drift stabilizer is used to function on the bi-directional plow. The bi-directional anti-drift stabilizer is attached to a mounting plate via an extension that protrudes outward from the mounting plate at a right angle. The use of a right angle allows the anti-drift stabilizer to function equally well whether the plow is moving snow to the left or to the right. When the plow blade is angled into the snow the angle at which the bi-directional anti-drift stabilizer hits oncoming snow tends to hold the plow towards the side where the snow is being deposited. This type of anti-drift stabilizer may be mounted with a further embodiment wherein an extension bar is supplied with a stabilizer plate. This embodiment is preferable on the bi-directional anti-drift stabilizer as the surface area of the stabilizer extension plate may be decreased, as the angle with which the bi-directional stabilizer contacts the snow is sharper than that of an angled, single direction anti-drift stabilizer. The use of the extension bar also creates an anti-drift stabilizer that carries less snow. This is desirable when plowing streets with open intersections as the plow will not drag as much snow, leaving a trail, through a cleared intersection.

For a better understanding of the present invention reference should be made to the drawings and the description in which there are illustrated and described preferred embodiments of the present invention.

DESCRIPTION OF THE PREFERRED EMBODIMENT

Figure 1:
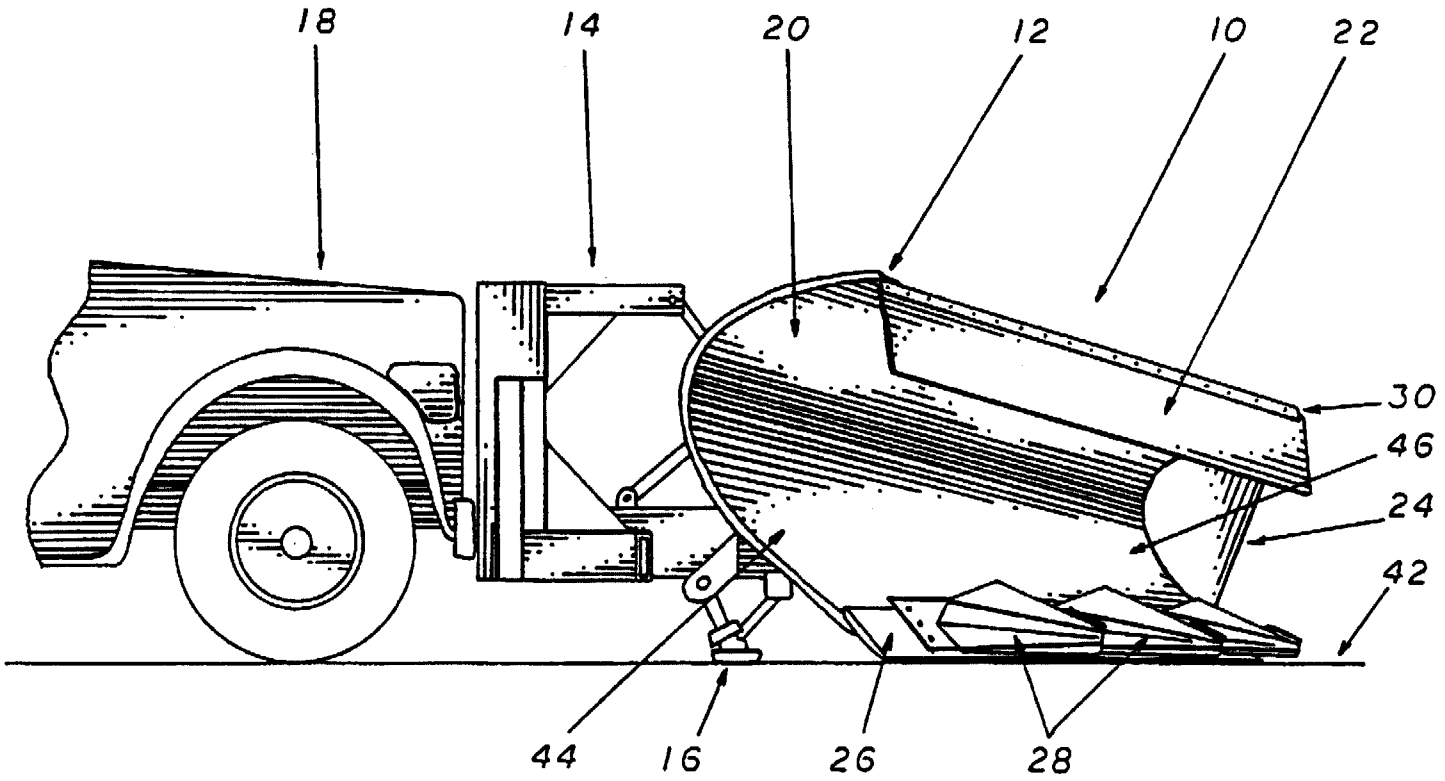
FIG. 1 is a side elevation view of the Plow Blade Anti-drift Stabilizer showing its orientation in relation to the snowplow and the plow vehicle.
Figure 2:
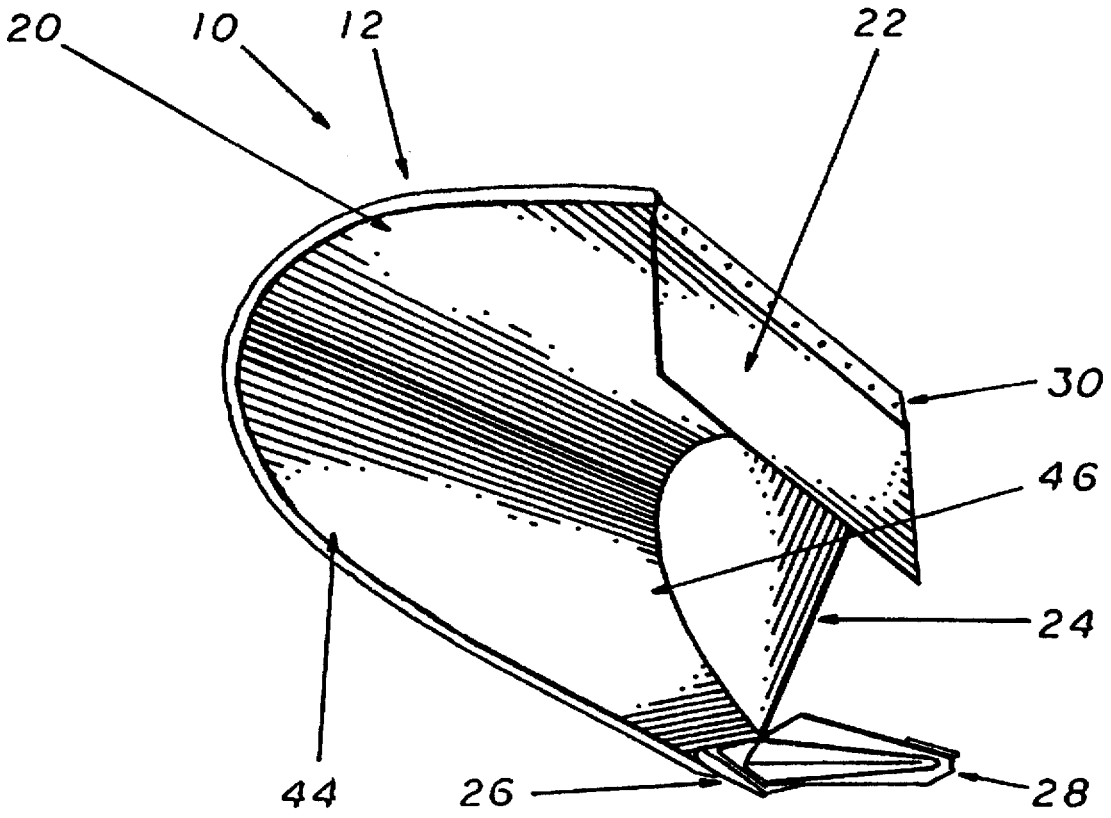
FIG. 2 is a side elevation of the present invention showing its orientation in relation to the snowplow and the snowplow blade.
Figure 3:
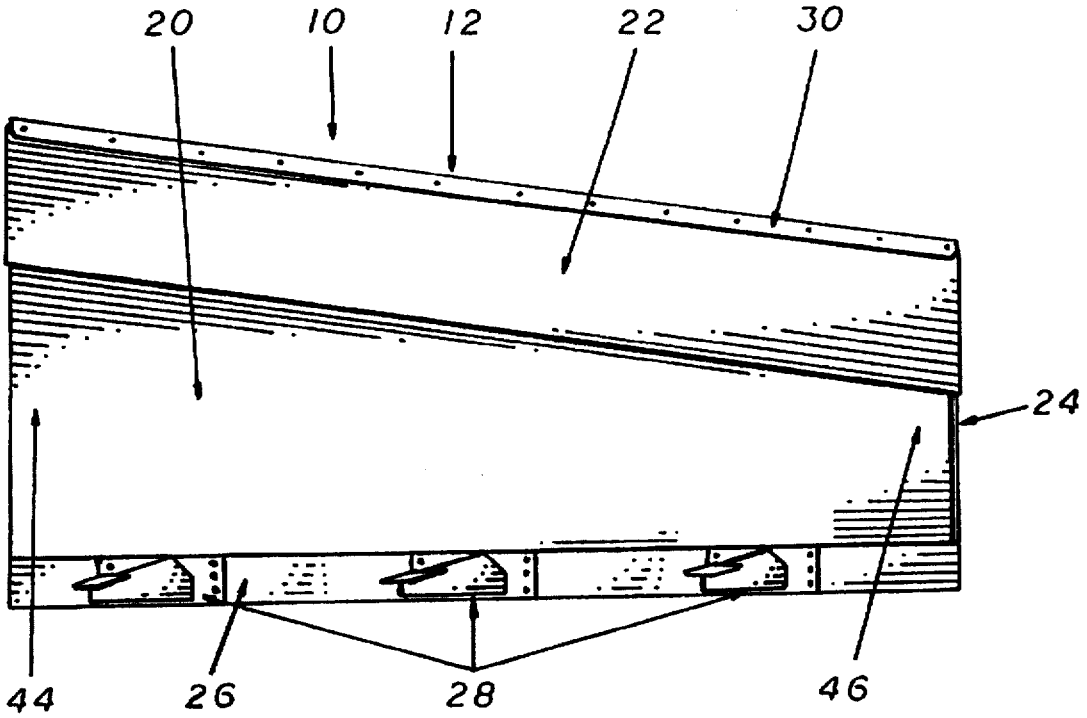
FIG. 3 is a front elevation view of the present invention again showing its orientation in relation to the snowplow and snowplow blade.

Referring now to the drawings, and more specifically to FIGS. 1, 2 and 3, the Plow Blade Anti-Drift Stabilizer 10 is connected to the plow vehicle 18 by means of the snowplow attachment frame 14 (it is important to note that when reference is made to a snowplow vehicle 18, it could denote any vehicle ranging from a standard pickup truck to a road grader having a belly mounted blade, but for the purpose of simplicity, a heavy duty truck is used as an illustration). The snowplow attachment frame 14 is hydraulically controlled from the cab of the plow vehicle 18 which allows the operator to raise and lower the snowplow 12 as needed. The height of the snowplow 12 in relation to the road surface 42 is controlled by the frame skids 16 which are located on the lower surface of the attachment frame 14 directly behind the snowplow 12. These frame skids 16 are adjustable and engage the road surface 42 at a point which allows the snowplow blade 26 to just touch the road surface 42.

Figure 6:
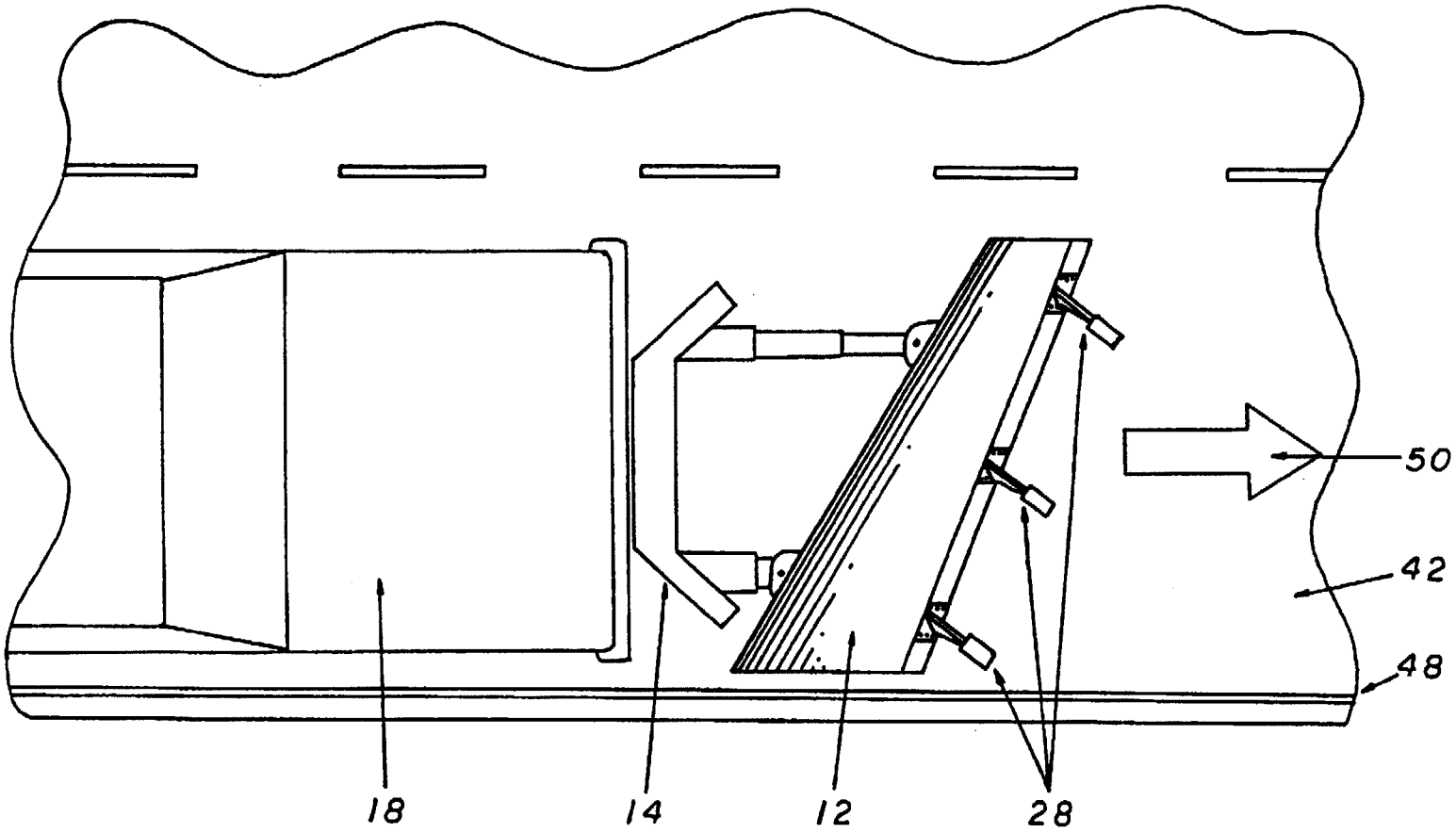
FIG. 6 is a top elevation view of the present invention showing the direction of travel of the snowplow and the manner in which the anti-drift stabilizers are mounted to the snowplow blade at an angle that is in the same direction as that of the snowplow in relation to the road and direction of travel.

These figures depict the typical manner of construction of a snowplow 12 and the placement of the anti-drift stabilizers 28 therein. The snowplow body 20 is a hemispherical funnel shaped apparatus with the large open end 44 and a small closed end 46. This basic shape is then mounted on a plow vehicle 18 at such an angle in relation to its longitudinal axis (the length of the plow vehicle, or from front to rear, as opposed to its horizontal axis, or from side to side) that the small closed end 46 is in a forward position in relation to the large open end 44. The direction of travel 50 along a road surface 42 of this configuration and the angles of the snowplow 12 and the anti-drift stabilizers 28 are depicted in FIG. 6.

Therefore, as a result of the angle and the funneled configuration, when the snowplow 12 is forced along the road surface 42, the snow that is collected by the snowplow 12 is channeled down its length and expelled to the side of the road 48 at the large open end 44 creating a force equal and opposite towards the other end. The efficiency of this system is increased when the plow vehicle 18 can be operated at a speed which causes the collected snow to roll-over. The anti-drift stabilizers 28 allow the snowplow 12 to be operated at this speed with minimal correction effort from the operator.

Additionally, the snowplow 12 is equipped with an outside snow retainer wall 24 and a retainer curtain 22. The retainer curtain 22 is attached to the upper leading edge of the snowplow by means of the retainer curtain attachment bracket 30. The outside snow retainer wall 24 is permanently attached to the entire hemispherical edge of the snowplow 12 from just behind the snowplow blade 26 at its lower leading edge to the upper leading edge, thereby forming the small closed end 46. These two features help to keep the collected snow within the snowplow 12 so that it can more effectively be expelled at the large open end 46.

While in operation, the snow collected by the entire length of the snowplow 12 accumulates at the large open end 44 just before it is expelled. The result of this is that there is pushing force created at the large open end 46 due to this accumulation of snow, thereby tending to force the plow vehicle 18 to "push" in the opposite direction, especially at medium and higher speeds. To counteract this problem the anti-drift stabilizers 28 are attached and extend forward from the snowplow blade 26 at an angle that is in the same direction as that of the snowplow 12 in relation to the longitudinal axis of the plow vehicle 18. This configuration results in a pressure being placed on the snowplow 12 through the anti-drift stabilizers 28 which serves to counteract the knifing action due to the accumulation of snow at the large open end 44 and the angle of the snowplow 12.

Figure 4:
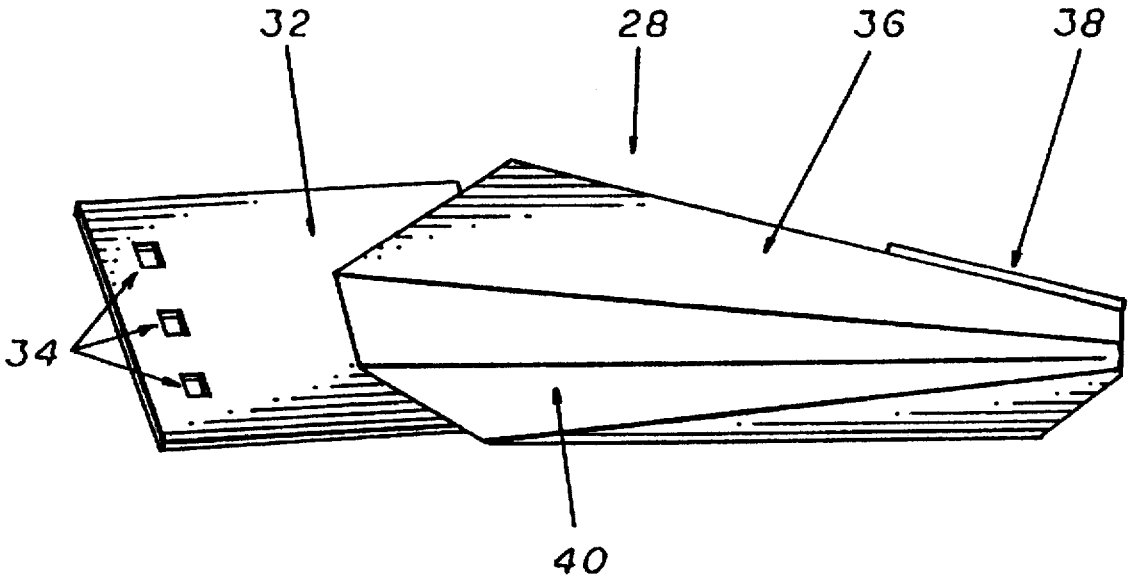
FIG. 4 is a side elevation view of the present invention showing the manner of its construction and more specifically, the manner in which the stabilizer body is connected to the attachment bracket.
Figure 5:
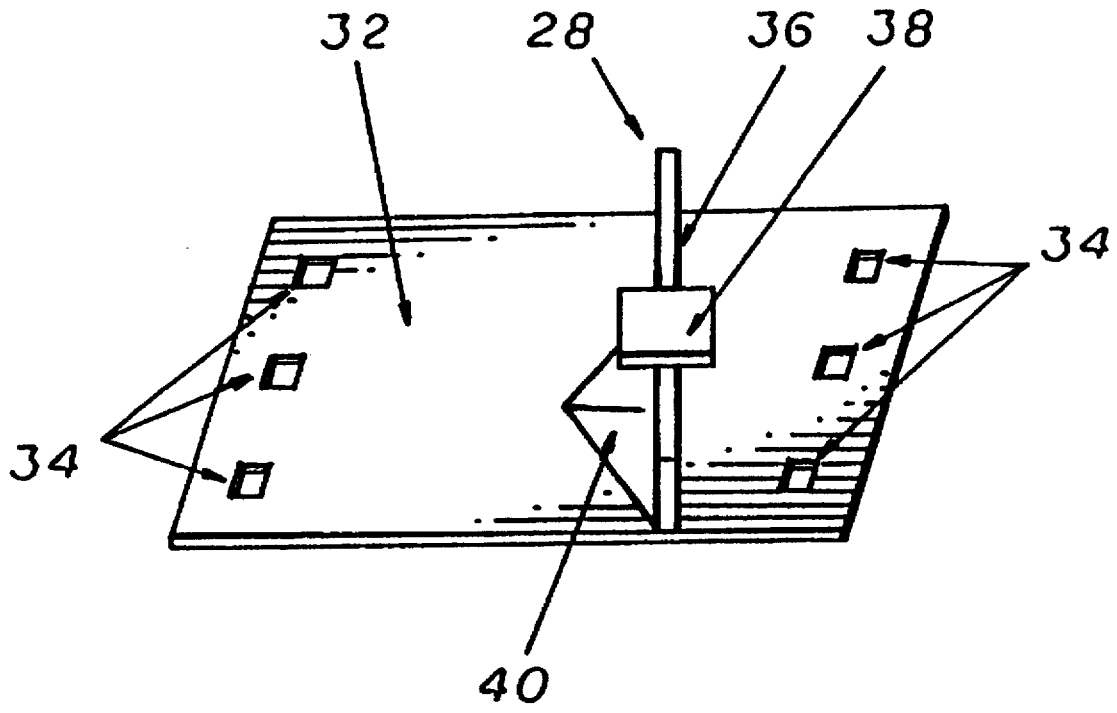
FIG. 5 is a front elevation view of the present invention showing its manner of construction and the relative position of the stabilizer body in relation to the attachment bracket.

As shown by FIGS. 4 and 5, the anti-drift stabilizers 28 are constructed primarily by the use of a stabilizer body 36 and a stabilizer attachment bracket 32. The stabilizer body 36 is permanently attached to the attachment bracket 32 at a vertical axis angle that allows the attachment bracket 32 to be flush mounted to the snowplow blade 26 while keeping the stabilizer body 36 in a horizontal position. The stabilizer attachment bracket 32 is mounted to the snowplow blade 26 by use of the plurality of holes 34 located in sets on the outside edges of the stabilizer attachment bracket 32. This configuration allows the height of the anti-drift stabilizers 28 to be adjusted in relation to the road surface 42.

The stabilizer body 36 also has attached to it a down force plate 38 which is mounted perpendicularly at its upper, leading edge. This creates a surface that angles downward in relation to the direction of travel of the anti-drift stabilizers 28 and, thus, creates down force that helps keep the snowplow blade in contact with the road surface 42. Additionally, the anti-drift stabilizers 28 are equipped with a beveled pressure surface 40 which tapers from the rear of the stabilizer body 36 to its front. The purpose of this feature is to increase the inner surface area of the anti-drift stabilizers 28, thus, reinforcing the anti-drift stabilizer body 36, thereby, adding additional strength to the attachment point of the stabilizer body 36 and the stabilizer attachment bracket 32. The beveled pressure surface 40 is generally placed on the inner side of the anti-drift stabilizers so that the flat or opposite side is angled out, thus allowing for snow or other media to pass with minimal accumulation during operation.

FIG. 6 depicts an overhead view of the configuration of a plow vehicle 18 with the snowplow 12 attached to it by means of the snowplow attachment frame 14. This figure illustrates the angle typically employed when the snowplow 12 is in use and the manner in which the anti-drift stabilizers 28 are mounted at an angle that is in the same direction as that of the snowplow 12 with respect to the direction of travel 50. Additionally, in this figure the direction of travel 50 is clearly shown as well as the side of the road 48 where the cleared snow is deposited by the snowplow 12.

Figure 7:
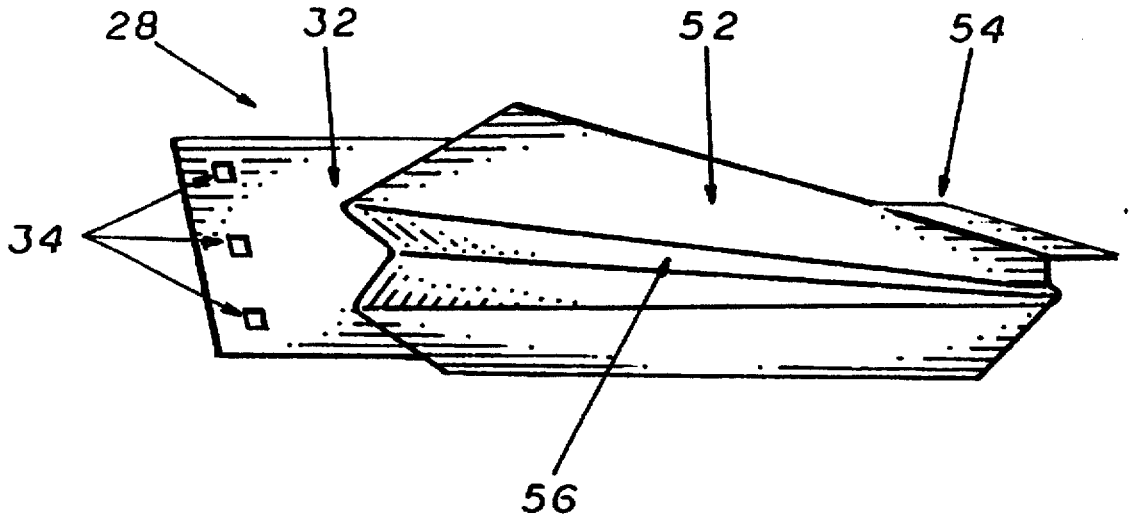
FIG. 7 is side perspective view of the present invention in an alternative configuration, stamped from a single sheet of material and showing the manner of its construction and more specifically, the manner in which the stabilizer body is connected to the attachment bracket.
Figure 8:
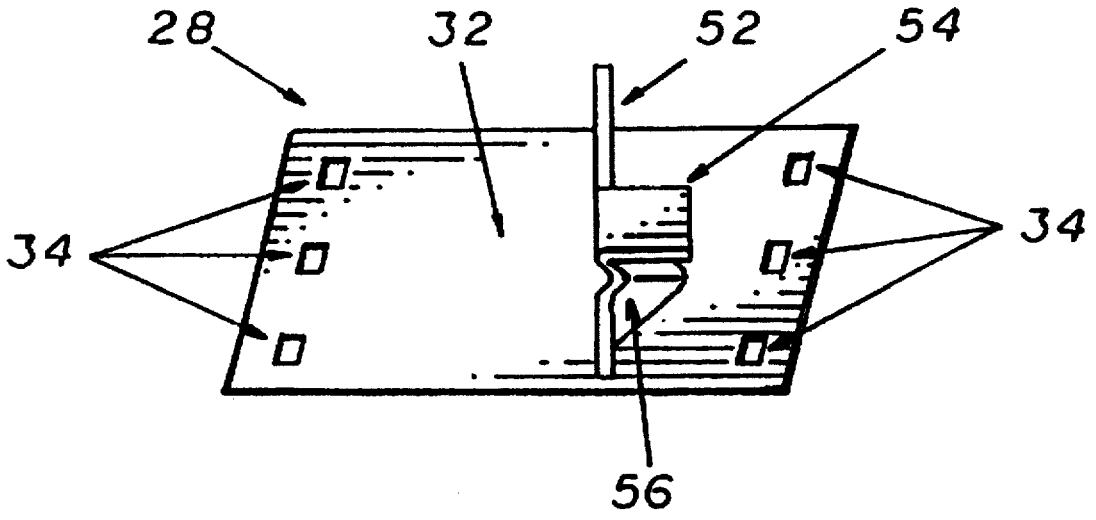
FIG. 8 is top elevation view of the present invention in an alternative configuration, stamped from a single sheet of material and showing its manner of construction and the relative position of the stabilizer body in relation to the attachment bracket.

As shown by FIGS. 7 and 8, the anti-drift stabilizers 28 are stamped from a single sheet of material to reduce production costs and time. The alternative anti-drift stabilizers 28 are constructed of a single stamp stabilizer body 52 and a stabilizer attachment bracket 32. The single stamp stabilizer body 52 is permanently attached to the attachment bracket 32 at a vertical axis angle that allows the attachment bracket 32 to be flush mounted to the snowplow blade 26 while keeping the single stamp stabilizer body 52 in a horizontal position. The stabilizer attachment bracket 32 is mounted to the snowplow blade 26 by use of the plurality of holes 34 located in sets on the outside edges of the stabilizer attachment bracket 32. This configuration allows the height of the anti-drift stabilizers 28 to be adjusted in relation to the road surface 42.

The single stamp stabilizer body 52 also has formed in it a single stamp down force plate 54 which is formed perpendicularly at its upper, leading edge. This creates a surface that angles downward in relation to the direction of travel of the anti-drift stabilizers 28 and, thus, creates down force that helps keep the snowplow blade in contact with the road surface 42. Additionally, the single stamp anti-drift stabilizer bodies 52 are equipped with a single stamp beveled pressure surface 56 which tapers from the rear of the stabilizer body 36 to its front. The purpose of this feature is to increase the inner surface area of the anti-drift stabilizers 28, thus, reinforcing the single stamp anti-drift stabilizer body 52, thereby, adding additional strength to the attachment point of the single stamp stabilizer body 36 and the stabilizer attachment bracket 32. The single stamp beveled pressure surface 56 is generally placed on the inner side of the anti-drift stabilizers so that the flat or inward opposite side is angled out, thus allowing for snow or other media to pass with minimal accumulation during operation.

Figure 9:
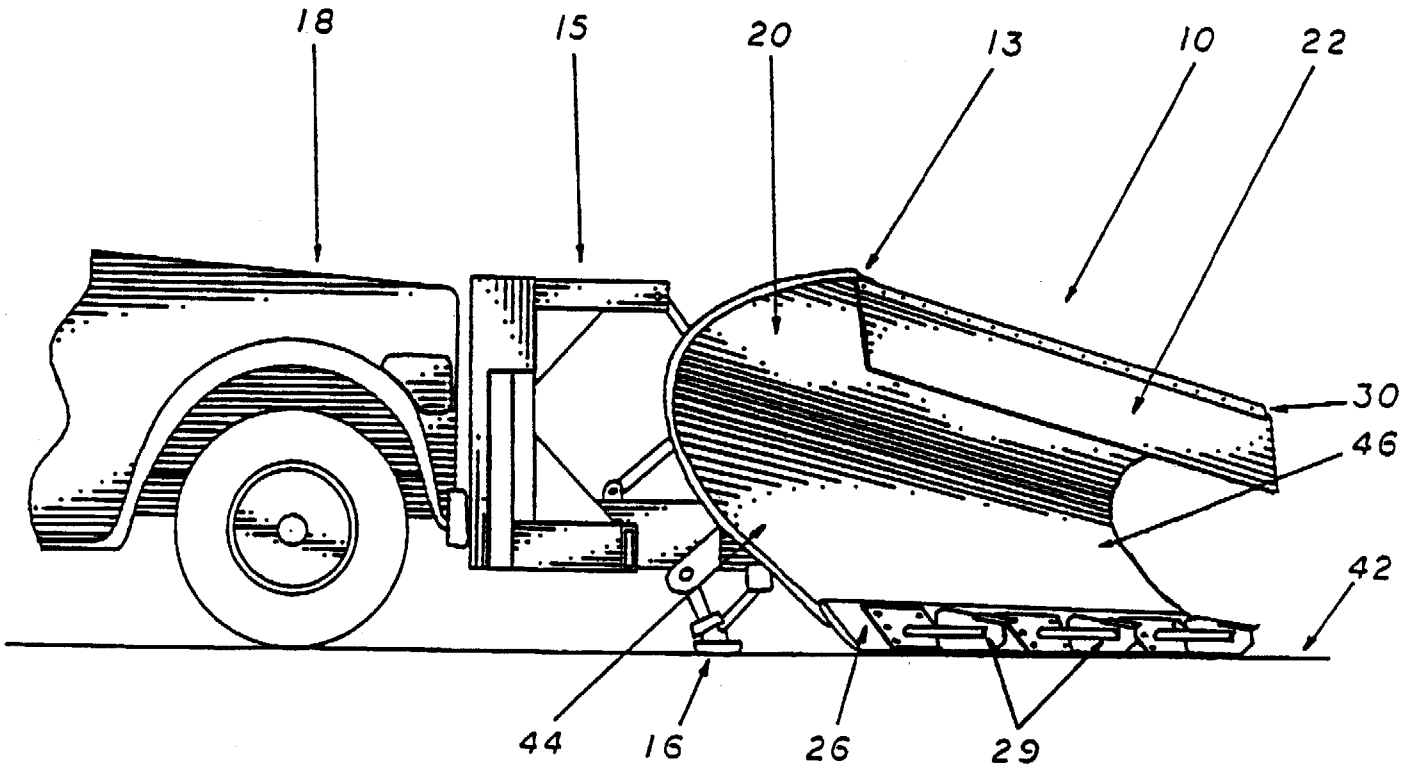
FIG. 9 is a side elevation view of an alternative embodiment of the Plow Blade Anti-drift Stabilizer showing its orientation in relation to the snowplow and the plow truck.
Figure 10:
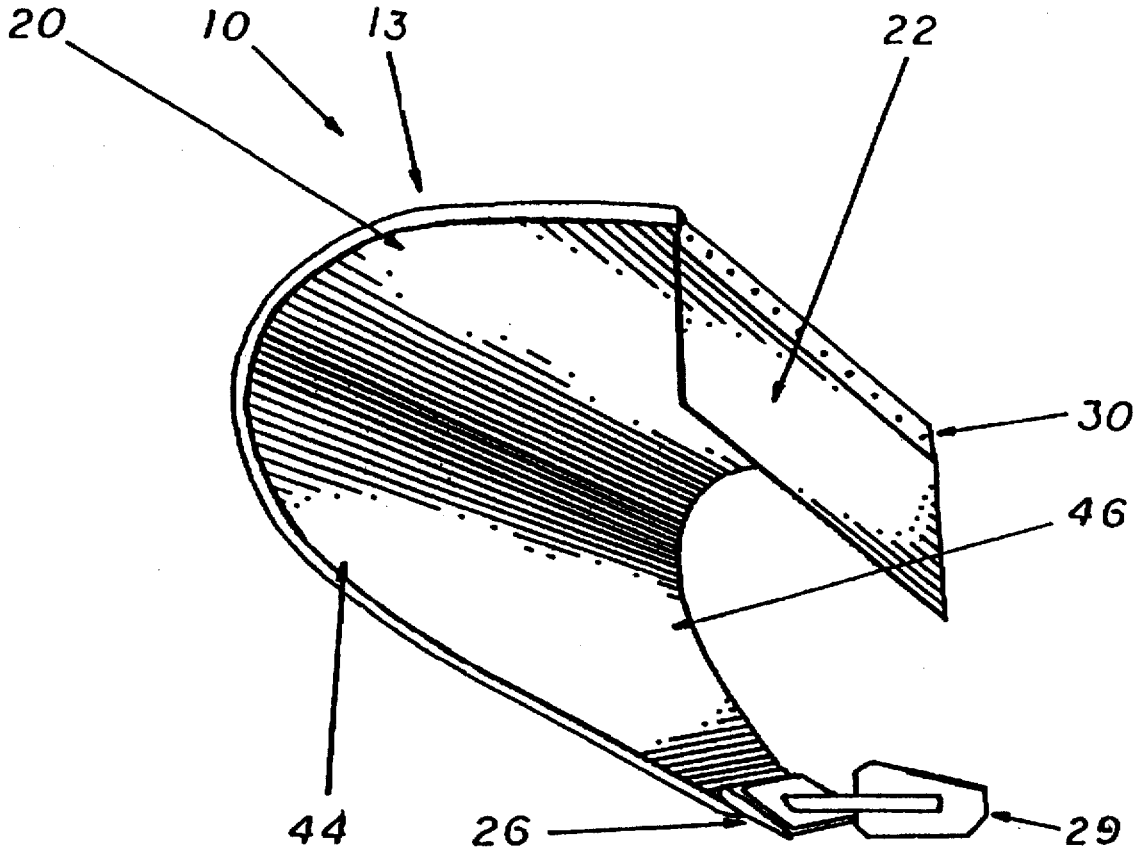
FIG. 10 is a side elevation view of an alternative embodiment of the present invention showing its orientation in relation to the snowplow and the snowplow blade.
Figure 11:
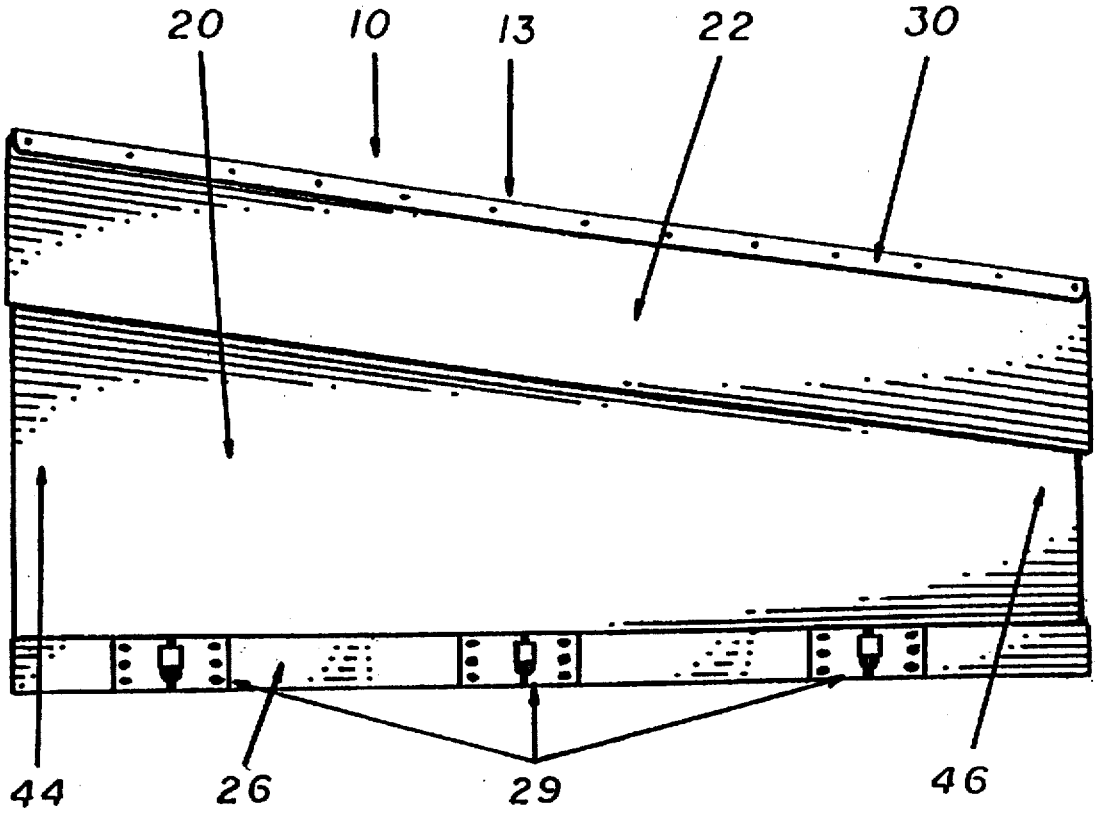
FIG. 11 is a front elevation view of an alternative embodiment of the present invention, again showing its orientation in relation to the snowplow and snowplow blade.

An alternative embodiment of the present invention is shown in FIGS. 9 through 14 inclusive. FIGS. 9, 10 and 11, depict the manner of attachment to a bi-directional snowplow 13 mounted to a bi-directional attachment frame 15 and orientation of the bi-directional anti-drift stabilizers 29. The primary difference in this embodiment in relation to the above described embodiments is that the bi-directional anti-drift stabilizer 29 is mounted to operate at a right angle to the lead edge of the of the bi-directional snowplow 13. This configuration allows the present invention to be used on a bi-directional snowplow 13 that can be pivotally rotated by use of the bi-directional attachment frame 15 in a manner that allows collected snow to be deposited on either side of a roadway 42 depending upon a particular situation.

Figure 12:
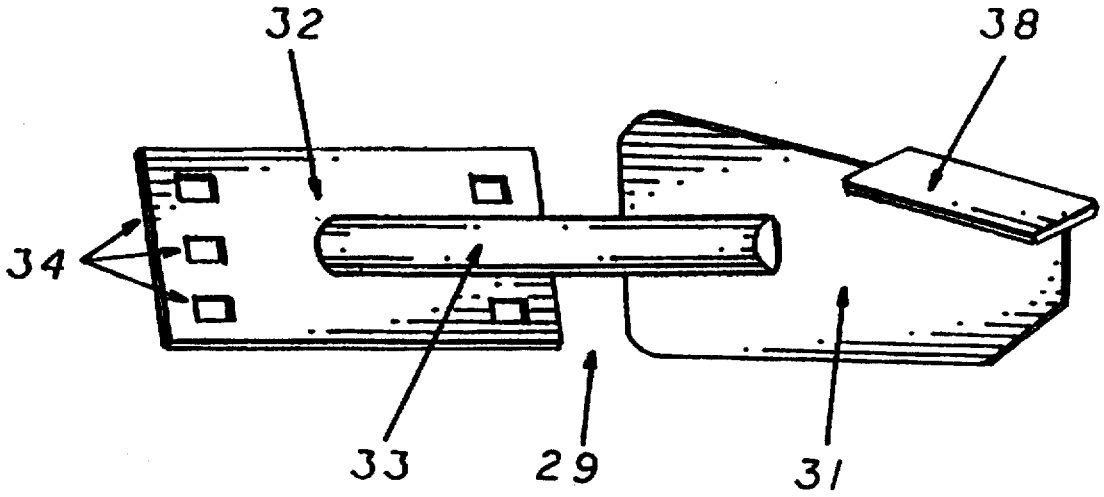
FIG. 12 is a side elevation view of an alternative embodiment of the present invention showing the manner of its construction and more specifically, the manner in which the stabilizer body is connected to the attachment bracket.
Figure 13:
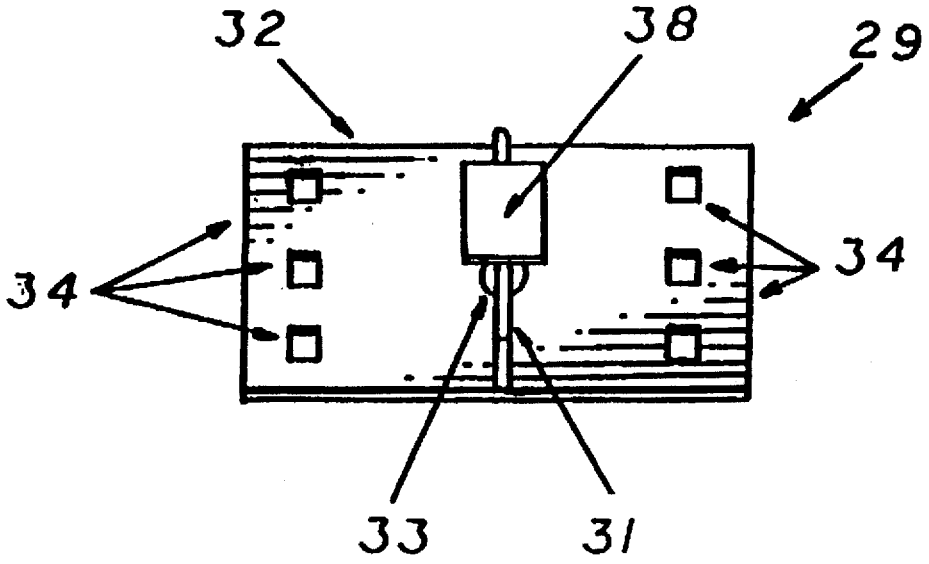
FIG. 13 is a front elevation view of an alternative embodiment of the present invention showing its manner of construction and the relative position of the stabilizer body in relation to the attachment bracket.
Figure 14:
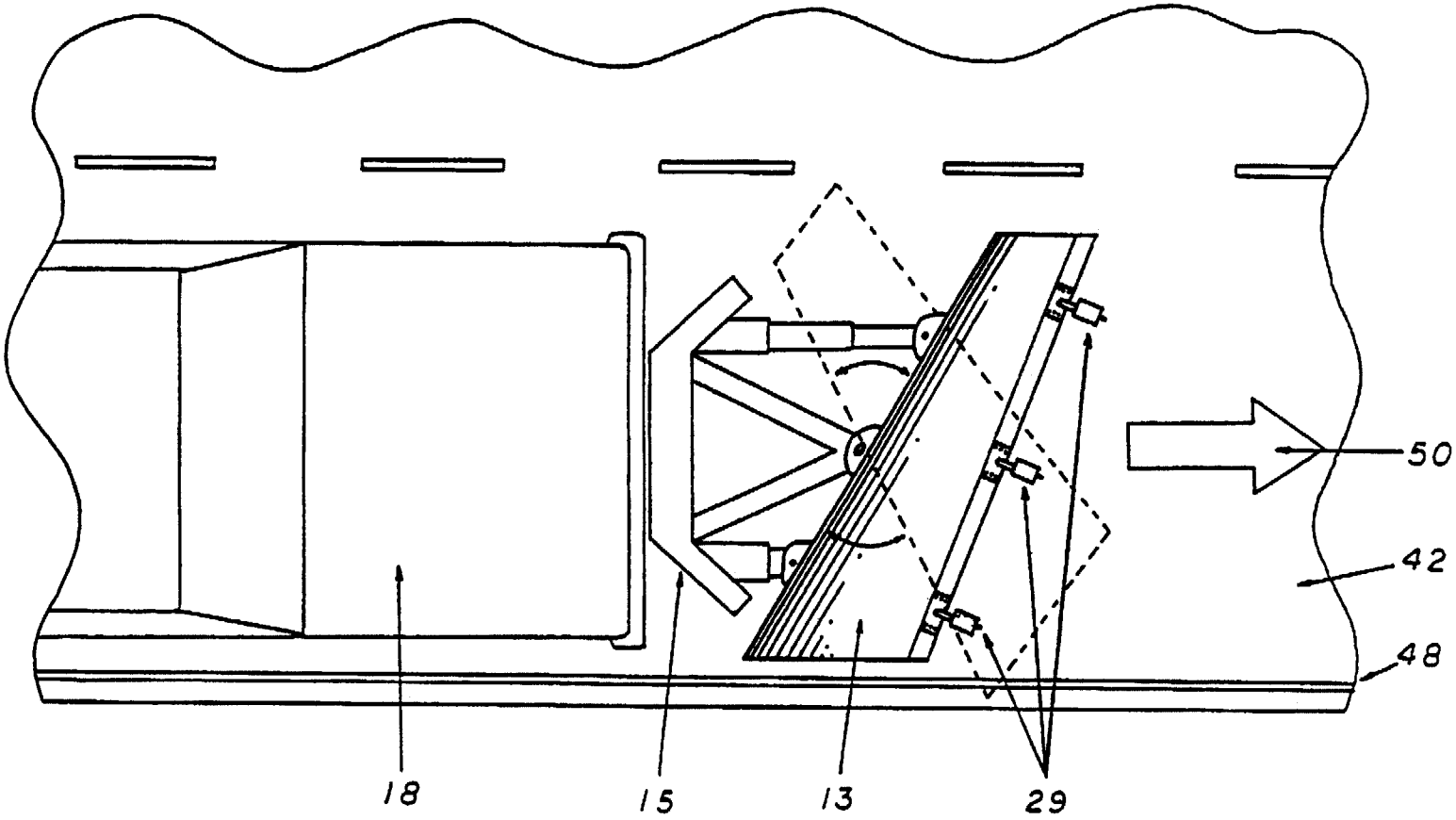
FIG. 14 is a top elevation view of an alternative embodiment of the present invention showing the manner in which the low speed anti-drift stabilizers are mounted and oriented on a pivoting snowplow blade that can be angled to disperse collected snow on either side of a given roadway.

FIGS. 12 and 13 detail the manner of construction of the bi-directional anti-drift stabilizers 29. The stabilizer plate 31 is mounted on the stabilizer extension bar 33 which extends outward at a right angle from the stabilizer attachment plate 32. This configuration allows the use of less surface area on the bi-directional anti-drift stabilizer plate 31, which in turn creates less drag on the bi-directional snowplow 13. Further, the mounting of the stabilizer extension 33 bar at a right angle allows the present embodiment to function equally whether the bi-directional plow 13 is biased to the left or to the right.

The typical situation and use of the bi-directional plow is in operating on city streets and crossing intersections. This type of plowing often calls for the plow to move at slow speeds, or with the blade in the up position, through intersections, while at other times, moving at a higher speed along straight sections of roads. The use low speed anti-drift stabilizer plate 31 and stabilizer extension bar 33 allows the present invention to carry less snow build up. This allows a bi-directional plow 13 to pass through areas that are already free of snow, such as intersections without the bi-directional anti-drift stabilizers 29 dragging excess snow and leaving a trail. F, it should be stated that the use of the extension bar 31 and the stabilizer plate 33 may be used with directional embodiment and thus, angled, if a given situation requires this type of embodiment.

Although the present invention has been described in considerable detail with reference to certain preferred versions thereof, other versions are possible. For example plows may be used to move other suitable media besides snow and various plow vehicles may be employed. Further the shape of the stabilizer may be modified to aid in production. Therefore, the spirit and scope of the appended claims should not be limited to the description of the preferred versions contained herein.

What is claimed is:

1. A stabilized plow for removing road impediments comprising:

a vehicle having a front, a rear, a first and second side and a horizontal axis running from said first side to said second side of said vehicle;

a plow attached to said vehicle said plow having a front portion and a lower edge, said plow being attached at a first angle from the horizontal axis of said vehicle so as to channel road impediments toward said first side of said vehicle;

at least one stabilizer portion extending forward from the front portion and at the lower edge of said plow, said stabilizer portion being attached to said plow at a second angle off of the horizontal axis of said vehicle so that said stabilizer portion points toward said first side of said vehicle and the angle between said stabilizer portion and said lower edge of said plow on said first side of said vehicle is less than ninety degrees.

2. A stabilized plow for removing road impediments as in claim 1 wherein said stabilizer portion further comprise a means of adjustably mounting said stabilizer portion to said plow.

3. A stabilized plow as in claim 2 wherein said stabilizer portion further comprise beveled side reinforcement bars.

4. A stabilized plow as in claim 1 wherein said stabilizer portion is formed from a single sheet of material.

5. A method of stabilizing a plow for removing road impediments comprising the steps of:

attaching a plow to a vehicle having a first and a second side and a horizontal axis running from said first side to said second side of said vehicle, said plow being attached at an angle from the horizontal axis of said vehicle so as to channel said road impediments to said first side of said vehicle;

suppling at least one stabilizer portion extending forward from the lower portion of said plow at a second angle that is biased towards said first side of said vehicle.

6. A method of stabilizing a plow as in claim 5 further comprising the step of:

reinforcing said stabilizer portion with beveled side reinforcement bars.

7. A method of stabilizing a plow as in claim 6 further comprising the step of:

forcing said stabilizer portion downward through the use of a down force plate fixedly attached to the end portion of said stabilizer portion.

8. A method of stabilizing a plow as in claim 5 further comprising the step of:

forming said individual stabilizer portion from a single sheet of material.

9. A stabilized bi-directional plow for removing road impediments comprising:

a vehicle having a front, a rear, a first and second side and a horizontal axis running from said first side to said second side of said vehicle;

a plow adjustably attached to said vehicle said plow having a front portion and a lower edge, said plow being adjustably attached from said horizontal axis of said vehicle so as to selectably channel road impediments towards said first side or said second side of said vehicle as desired;

at least one stabilizer portion having a first and second side and extending forward perpendicularly from the lower edge of said plow; and a flat section about both said first and second side of said stabilizer portion so as to apply force and pull said vehicle towards the side which said plow is selectably biased towards.

10. A stabilized bi-directional plow for removing road impediments as in claim 9 wherein said stabilizer portion further comprise a mounting plate for adjustably mounting said stabilizer portion to said plow.

11. A stabilized bi-directional plow as in claim 10 wherein said stabilizer portion further comprise an extension bar fixedly extending perpendicular from said mounting plate and a stabilizer plate mounted to said extension bar.

12. A method of stabilizing a bi-directional plow for removing road impediments comprising the steps of:

adjustably attaching a plow to a vehicle having a first side, a second side and a horizontal axis running from said first side to said second side of said vehicle, said plow being attached at an angle from said horizontal axis of said vehicle so as to selectably channel road impediments towards said first side or said second side of said vehicle as desired;

suppling at least one stabilizer portion extending forward from the lower portion of said plow at a perpendicular angle; and suppling said stabilizer portion with a flat section about both said first and second side of said stabilizer portion so as to apply force and pull said vehicle towards the side which said plow is selectably biased towards.

13. A method of stabilizing a bi-directional plow as in claim 12 further comprising the step of:

adjustably mounting said stabilizer portion to said plow with a mounting plate.

14. A method of stabilizing a bi-directional plow as in claim 13 further comprising the step of:

mounting an extension bar perpendicular from said mounting plate and attaching a stabilizer plate to said extension bar so as to form said stabilizer portion.

* * * * *